United States Patent [19]

Nobel

[11] 4,357,876

[45] Nov. 9, 1982

[54] DRIVERLESS VEHICLE WITH PROPORTIONAL DRIVE

[75] Inventor: Bruce Nobel, Bath, Pa.

[73] Assignee: Si Handling Systems, Inc., Easton, Pa.

[21] Appl. No.: 141,098

[22] Filed: Apr. 17, 1980

[51] Int. Cl.[3] ..... B61B 13/12

[52] U.S. Cl. ..... 104/166

[58] Field of Search ..... 104/165, 166; 105/29 R, 105/30; 180/24.02, 313

[56] References Cited

U.S. PATENT DOCUMENTS

| | | | |
|---|---|---|---|
| 3,356,040 | 12/1967 | Fonden | 104/166 |
| 3,641,939 | 2/1972 | Remy | 104/293 |
| 3,818,837 | 6/1974 | Jacoby et al. | 104/166 |
| 3,871,465 | 3/1975 | Nichols | 180/65 R X |

*Primary Examiner*—Randolph A. Reese

*Attorney, Agent, or Firm*—Seidel, Gonda, Goldhammer & Panitch

[57] ABSTRACT

A driverless vehicle for riding on a track has a drive wheel driven by a drive tube. The drive wheel is coupled to a substrate which in turn is coupled to the deck so that a portion of the load is transmitted to the drive wheel and the remainder of the load is transmitted through a separate substrate to the support wheels.

9 Claims, 4 Drawing Figures

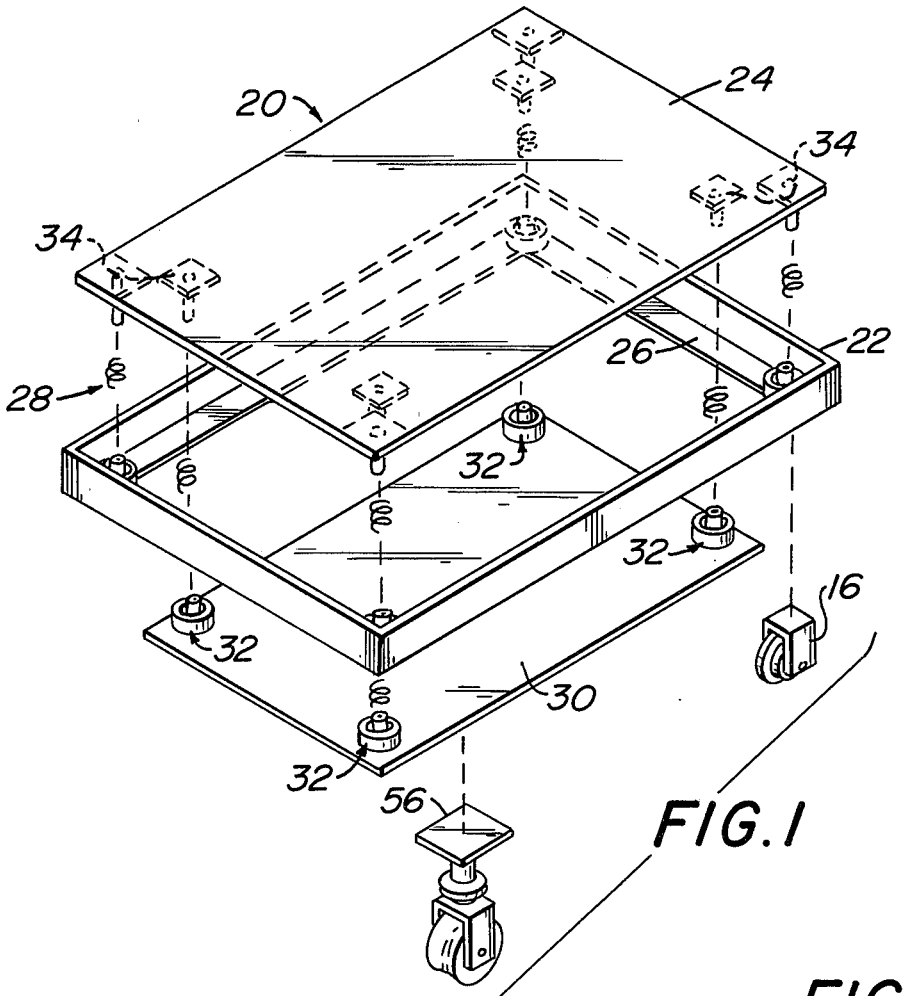
FIG. 1
FIG. 3
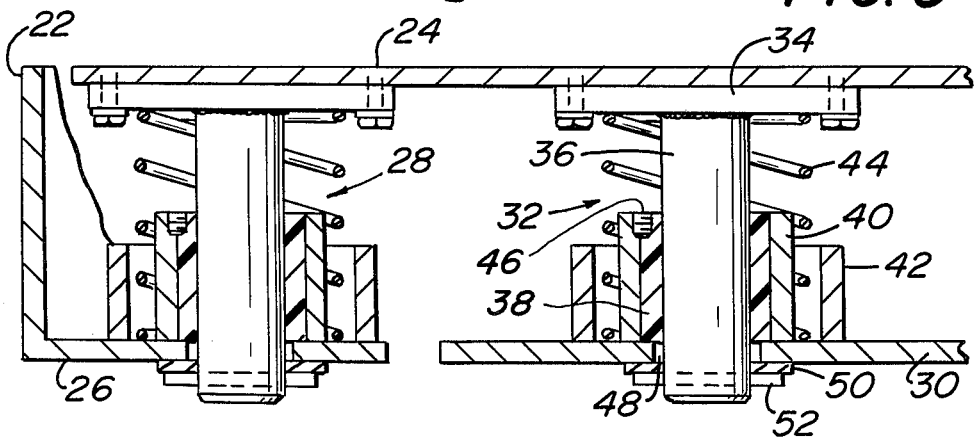

DRIVERLESS VEHICLE WITH PROPORTIONAL DRIVE

BACKGROUND OF THE INVENTION

The driverless vehicle of the present invention is of type disclosed in U.S. Pat. No. 3,356,040. The typical driverless vehicle of this type includes a deck having support wheels which ride on a pair of tracks. The vehicle is driven by the interrelationship between a drive wheel supported by the deck and a drive tube disposed between the tracks and in contact with the drive wheel.

The problem involved is as follows. When a vehicle is empty or has no load, it takes very little force to drive the vehicle. When the vehicle has a heay load, a large force is needed to move the vehicle. One solution was to attain an increased driving force by using two drive wheels coupled together on a common support. See U.S. Pat. No. 3,818,837 which teaches such plural drive wheels.

Another solution to the problem has been the use of a specially designed drive wheel with a large spring force thereby requiring a very heavy vehicle deck to hold the vehicle on the track when it is empty. If the deck is too light, the spring force lifts the vehicle off the track. The second alternative increases the cost of the vehicle and the system drive requirements.

SUMMARY OF THE INVENTION

The driverless vehicle of the present invention includes at least one substrate below and coupled to a deck of the vehicle by an assembly whereby the force transmitted from the deck to the substrate varies with the load on the deck. The vehicle has support wheels which are adapted to ride on tracks and a drive wheel adapted to be driven by a cylindrical drive tube. The drive wheel is supported from the substrate by a mount and is adapted for rotation about a horizontal axis. The mount and the drive wheel are pivotable as a unit about an upright axis between a drive position and a stop position. Only a portion of the load is transmitted directly to the drive wheel and the remainder of the load is transmitted directly to the support wheels.

In a preferred embodiment of the present invention, there are a pair of substrates and the assembly coupling each substrate to the deck includes a plurality of spring assemblies. The spring assemblies are only slightly compressed when the deck is empty or has no load. Compression of the spring assemblies varies with the load on the vehicle. The spring assemblies are preferably designed so as to regulate the force transferred to the drive wheel and to prevent the assembly from bottoming out at full load.

It is an object of the present invention to provide a novel driverless vehicle wherein the drive force is proportional to the load so that only a portion of the load is transmitted to the drive wheel and the remainder is transmitted to the support wheels.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is an exploded view of a vehicle in accordance with the present invention.

FIG. 3 is a sectional view taken along the line 3—3 in FIG. 2.

DETAILED DESCRIPTION

Figure 2:
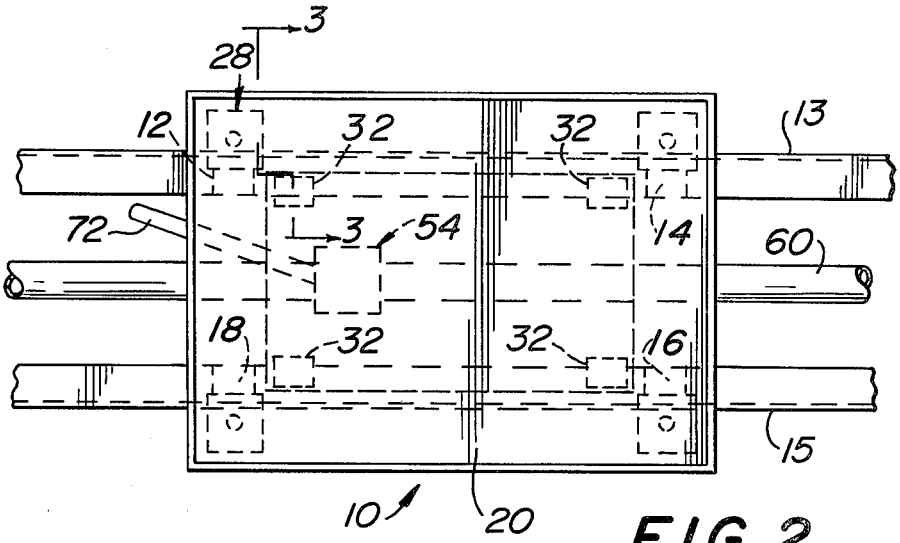
FIG. 2 is a top plan view of a portion of a track and the vehicle of the present invention.

Referring to FIGS. 1 and 2, there is shown a driverless vehicle in accordance with the present invention designated generally as 10. The vehicle 10 includes support wheels 12, 14, 16 and 18 which rotate about horizontal axes transverse of the vehicle. The wheels 12 and 14 are adapted to ride on the track 13 while the wheels 16 and 18 are adapted to ride on the track 15.

Referring to FIG. 1, the vehicle 10 includes a deck 20 which may assume a wide variety of shapes. For purposes of illustration, the deck 20 includes a deck plate 24 surrounded by a frame 22 having a substrate in the form of an inwardly directed horizontal flange 26. The periphery of plate 24 is coupled to the frame 22 by four spring assemblies 28. See FIG. 3 wherein assembly 28 couples the plate 24 to the flange 26 on the inner periphery of the frame 22.

A discrete substrate 30 is provided below the deck 20 and coupled thereto by a plurality of assemblies 32 whereby the force transmitted from the deck 20 to the substrate 30 varies with the load on the deck 20. Such assemblies may assume a wide variety of configurations. A preferred configuration is a spring assembly due to its simplicity and low cost. The spring assemblies 28 and 32 are identical except for the stiffness of springs and I prefer to utilize four such assemblies in connection with each substrate. Hence, only spring assembly 32 will be described in detail.

Referring to FIG. 3, the spring assembly 32 includes a mounting plate 34 rigidly secured to the bottom of deck plate 24 in any convenient manner such as by the use of bolts. A guide rod 36 is integral with and extends downwardly from the plate 34 so as to be vertically disposed. Rod 36 extends through a bushing 38 which is surrounded by a pair of radially spaced guide rings 40, 42. Rings 40, 42 are fixedly secured to the upper surface of substrate 30. A spring 44 extends between the substrate 30 and the mounting plate 34 while surrounding the pin 36. The lower end of the spring 44 extends into the annular channel defined by the space between the rings 40, 42.

The bushing 38 is secured to the ring 40 in any convenient manner such as by the set screw 46. The substrate 30 has a hole 48 through which the rod 36 extends. Beneath the substrate 30, a washer 50 surrounds the rod 36. Beneath the washer 50, a pin 52 extends transversely through the rod 36 so as to prevent rod 36 from moving upwardly beyond the predetermined point. Pin 52 prevents the spring assemblies 32 from trying to raise an empty deck 20 off the tracks 13 and 15. This allows a vehicle to be designed so that the spring assemblies are strong enough to support the maximum load.

Figure 4:
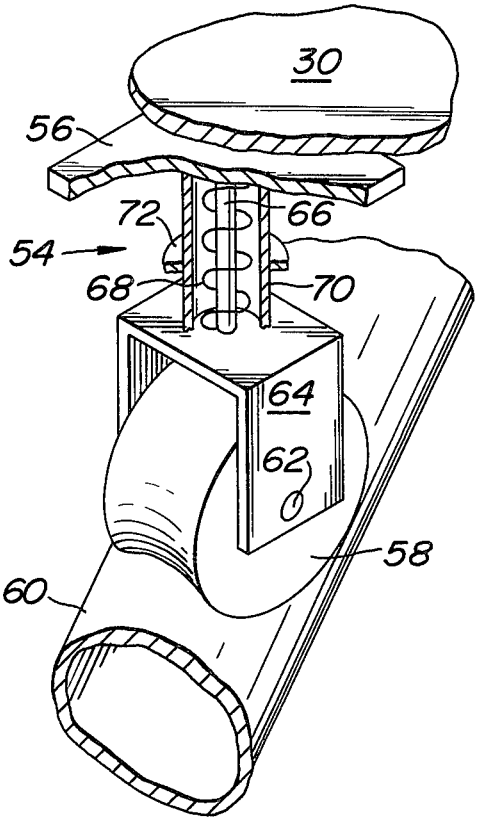
FIG. 4 is a partial perspective view showing the relationship between the drive wheel and the cylindrical drive tube.

Referring to FIG. 4, there is illustrated a drive wheel assembly designated generally as 54. Assembly 54 is similar to that disclosed in U.S. Pat. No. 3,356,040. Hence, the theory in connection with such a drive wheel assembly will not be descibed in detail. The assembly includes a mounting plate 56 fixedly secured to a bottom surface on the substrate 30. The drive wheel 58 is in rolling contact with a drive tube 60 which is rotated about its longitudinal axis. Wheel 58 rotates about a horizontal axis defined by the mounting pin 62. The axis of pin 62 is at an acute angle with respect to the longitudinal axis of tube 60. To insure constant thrust when crossing joints of tube 60, two assemblies 54 may be used.

Wheel 58 is supported by the yoke 64 for rotation as a unit with wheel 58 about a vertical axis defined by rod 66. Rod 66 is connected at its upper end to the plate 56. The yoke 64 is rotatable with respect to the rod 66 and includes an upstanding integral sleeve 70 which surrounds rod 66. A spring 68 extends between and has its ends secured to the plate 56 and the yoke 64. Spring 68 is preferably a torsion spring so as to bias the yoke 64 to a position so that the axis of rotation of wheel 58 is at an angle of approximately 45° with respect to the longitudinal axis of tube 60. Unlike the prior art, spring 68 is not a compression spring. The force maintaining wheel 58 in contact with tube 60 is the vehicle load. When the deck 20 is empty the load on wheel 58 is a portion of the weight of deck 20 as determined by the force of springs 44 and desired vehicle thrust.

The spring assemblies regulate the force transferred to the drive wheel 58 as a function of load. Let it be assumed that deck 20 weighs 200 lbs and the spring force of assemblies 28 is 9 times as great as that for assemblies 32. At no load, the downward force on wheel 58 is a portion of the weight of deck 20 such as 100 lbs. to attain 30 lbs. of thrust. If a load of 800 lbs. is put on deck 20, each assembly 32 supports 20 lbs. with each spring assembly 28 supporting 180 lbs. The force needed to accelerate and move the vehicle 10 equals the coefficient of friction between wheel 58 and tube 60 multiplied by the downward force on wheel 58. As explained above, this invention enables the downward force on wheel 58 to change as a function of the load on vehicle 10. Such regulation is attained in a manner which is simple, inexpensive and reliable.

The rotation of the drive wheel assembly 54 so as to cause the axis of wheel 58 to be parallel to the axis of tube 60 can be accomplished in a wide variety of manners. One such manner is to provide an activator 72 which projects forwardly of the vehicle for contact with mating structure on another vehicle to thereby prevent collision of vehicles in the manner described in U.S. Pat. No. 3,818,837. Activator 72 may also be manipulated by contact with a selectively operable contact surface at a location where it is desired to cause the vehicle 10 to stop for loading, unloading, etc.

The present invention may be embodied in other specific forms without departing from the spirit or essential attributes thereof and, accordingly, reference should be made to the appended claims, rather than to the foregoing specification, as indicating the scope of the invention.

I claim:

1. A driverless vehicle comprising a deck, means including one substrate below a portion of the deck, support wheels coupled to said deck and adapted to ride on tracks, a drive wheel adapted to be driven by a centrifugal drive tube, a mount, said drive wheel being supported from the substrate by said mount for rotation about a horizontal axis, said mount and drive wheel being coupled to said substrate so as to be pivotable about an upright axis between a drive position and a stop position, means including assemblies coupling said deck to said substrate and support wheels so that the downward force transmitted from the deck to the substrate varies with the load on the deck with only a portion of the load being transmitted directly to the drive wheel and the remainder of the load being transmitted to the support wheels thereby controlling the force between the drive wheel and the drive tube to be in driving frictional contact therewith.

2. A vehicle in accordance with claim 1 wherein said assembly is a plurality of spring assemblies extending between said deck and said substrate.

3. A driverless vehicle in accordance with claim 2 wherein each spring assembly includes a guide pin on the deck which may move downwardly with respect to the substrate and whose upward movement with respect to the substrate is limited, a spring surrounding the guide rod and extending between the deck and the substrate.

4. A vehicle in accordance with claim 1 wherein said drive wheel is spring biased to a position where its axis is at an angle of about 45° with respect to the axis of a drive tube.

5. A driverless vehicle in accordance with claim 1 wherein said deck includes a deck plate coupled by said assemblies to said substrate and a deck frame to which the support wheels are coupled.

6. A driverless vehicle comprising a deck, first and second substrates below the deck, said first substrate having support wheels adapted to ride on tracks, said second substrate having a drive wheel adapted to be driven by frictional contact with a cylindrical drive tube, said drive wheel being supported from the second substrate for rotation about a horizontal axis and being pivotable about an upright axis between a drive position and a stop position, means coupling each substrate to said deck so that the downward force transmitted from the deck to the drive wheel and to the first substrate varies with the load.

7. A vehicle in accordance with claim 6 wherein said means includes four spring assemblies extending between said deck and each substrate.

8. A driverless vehicle in accordance with claim 7 wherein each spring assembly includes a guide pin on the deck which may move downwardly with respect to its substrate and whose upward movement with respect to its substrate is limited, a discrete spring surrounding each guide rod and extending between the deck and the associated substrate.

9. A driverless vehicle in accordance with claim 6 wherein said second substrate is inwardly from the inner periphery of said first substrate and spaced therefrom.

* * * * *